US008973643B2

(12) United States Patent
Molteni

(10) Patent No.: US 8,973,643 B2
(45) Date of Patent: Mar. 10, 2015

(54) MULTIPANEL SLIDING DOOR

(75) Inventor: Piero Molteni, Milan (IT)

(73) Assignee: Unifor S.p.A., Turate, Como (IT)

( * ) Notice: Subject to any disclaimer, the term of this patent is extended or adjusted under 35 U.S.C. 154(b) by 576 days.

(21) Appl. No.: 12/465,891

(22) Filed: May 14, 2009

(65) Prior Publication Data

US 2009/0272038 A1 Nov. 5, 2009

Related U.S. Application Data

(62) Division of application No. 10/583,322, filed as application No. PCT/IT2005/000203 on Apr. 12, 2005, now abandoned.

(30) Foreign Application Priority Data

Apr. 15, 2004 (IT) ..... MI200400170 U

(51) Int. Cl.

| | |
|---|---|
| ***E05D 15/06*** | (2006.01) |
| ***E06B 3/92*** | (2006.01) |
| ***E05F 17/00*** | (2006.01) |
| *E05D 15/08* | (2006.01) |
| *E05F 15/14* | (2006.01) |

(52) U.S. Cl.

CPC ..... *E06B 3/922* (2013.01); *E05F 17/004* (2013.01); *E05D 15/08* (2013.01); *E05F 15/142* (2013.01); *E05Y 2800/122* (2013.01); *E05Y 2900/132* (2013.01)

USPC ..... 160/197; 160/196.1

(58) Field of Classification Search

USPC ..... 160/196.1, 197, 202, 214, 218, 222; 49/362, 125, 100–103

See application file for complete search history.

(56) References Cited

U.S. PATENT DOCUMENTS

| | | | | |
|---|---|---|---|---|
| 1,093,731 | A | 4/1914 | Scullin et al. | |
| 1,960,860 | A * | 5/1934 | Allen | 160/188 |
| 3,744,184 | A | 7/1973 | Niemi et al. | |
| 4,616,451 | A | 10/1986 | Glick | |
| 4,635,699 | A * | 1/1987 | Kauffman et al. | 160/211 |
| 5,388,370 | A | 2/1995 | Tonsmann | |
| 6,119,402 | A | 9/2000 | Wisner | |
| 6,161,334 | A | 12/2000 | Goodin | |
| 6,161,336 | A | 12/2000 | Ziv-Av | |
| 6,276,092 | B1 | 8/2001 | Neo | |

(Continued)

FOREIGN PATENT DOCUMENTS

| | | |
|---|---|---|
| DE | 90 13 808.2 | 12/1990 |
| DE | 41 37 442 A1 | 7/1992 |

(Continued)

OTHER PUBLICATIONS

International Search Report mailed Aug. 2, 2005 for International Application No. PCT/IT2005/000203.

(Continued)

*Primary Examiner* — Katherine Mitchell
*Assistant Examiner* — Jeremy Ramsey
(74) *Attorney, Agent, or Firm* — Shoemaker and Mattare

(57) ABSTRACT

The multipanel sliding door comprises at least two panels which are supported for travel in substantially parallel planes along runners, and is characterized in that a rack and wheelwork arrangement is provided for the movement of the door panels.

1 Claim, 6 Drawing Sheets

(56) References Cited

U.S. PATENT DOCUMENTS 7,424,935 B1 9/2008 Smith
7,730,929 B2 * 6/2010 Perron ..... 160/202

FOREIGN PATENT DOCUMENTS

JP 09151668 A * 6/1997
JP 2003-20861 1/2003

OTHER PUBLICATIONS

U.S. Patent Office Restriction Requirement mailed Jul. 31, 2008 for U.S. Appl. No. 10/583,322.
U.S. Patent Office Action mailed Nov. 28, 2008 for U.S. Appl. No. 10/583,322.

* cited by examiner

MULTIPANEL SLIDING DOOR

This application is a divisional application of Ser. No. 10/583,322, filed Jun. 16, 2006 which is the National Stage of PCT/IT2005/000203, filed Apr. 12, 2005.

TECHNICAL FIELD

The present invention relates to multipanel sliding doors, such as those used for providing a controlled access to an entranceway or the like in a wall or similar building structure.

BACKGROUND ART

Multipanel sliding doors of the kind mentioned above generally comprise two or more panels which are supported for travel in substantially parallel planes along runners. In a known arrangement, the door panels are caused to move in a stepwise manner, i.e. the door panels are interconnected to each other in such a way that, in closing the door, a first panel is caused to move in one direction and, once it has covered a certain distance, said first panel engages a second panel and pulls it along in its movement. The second panel, in turn, after having covered a certain distance, engages a third panel, and so on until all the panels of the door are drawn out to the full extension. In opening the door, the panels are moved in the same sequence as described above, but in an opposite direction.

An arrangement of this kind has at least two significant disadvantages in operation. The first is concerned with the noise produced by the knocking of a moving panel against a stationary panel, when the former is moved into engagement with the latter.

A second disadvantage is that opening and closing of the door is achieved through a number of steps each requiring a pulling or pushing effort which increases with the number of panels which are operated.

SUMMARY OF THE INVENTION

The present invention is directed to an improvement to a multipanel sliding door of the kind mentioned above so that said disadvantages are avoided and the operation of the door panels is synchronised.

The invention achieves this object by providing a multipanel sliding door comprising at least two panels which are supported for travel in substantially parallel planes along runners, characterised in that a rack and wheelwork arrangement is provided for the movement of the door panels.

BRIEF DESCRIPTION OF DRAWINGS

The invention will now be elucidated in connection with the figures of the accompanying drawings, wherein.

BEST MODE FOR CARRYING OUT THE INVENTION

Figure 1:
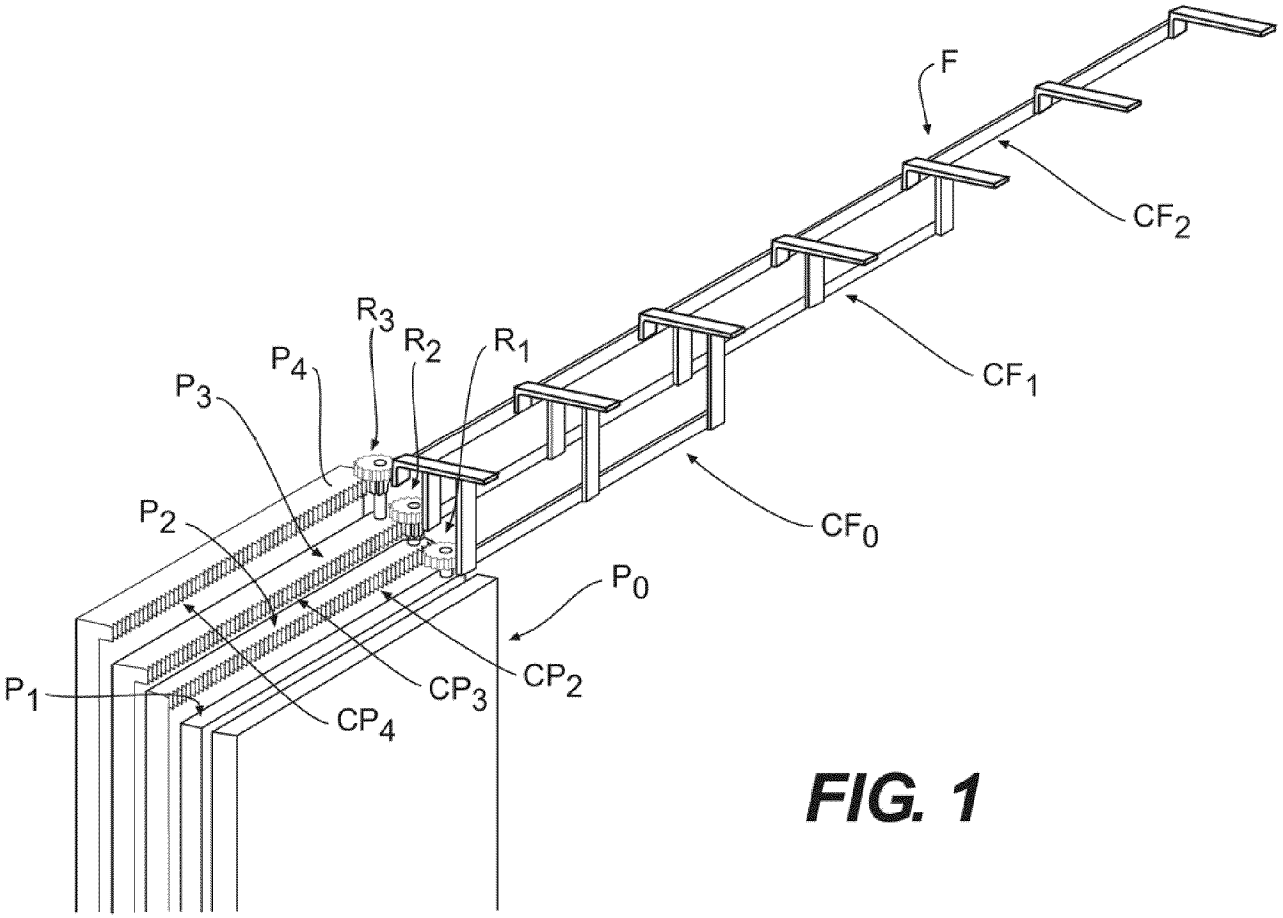
FIG. 1 is a perspective partial view of a first preferred embodiment of the multipanel sliding door according to the present invention.
Figure 2:
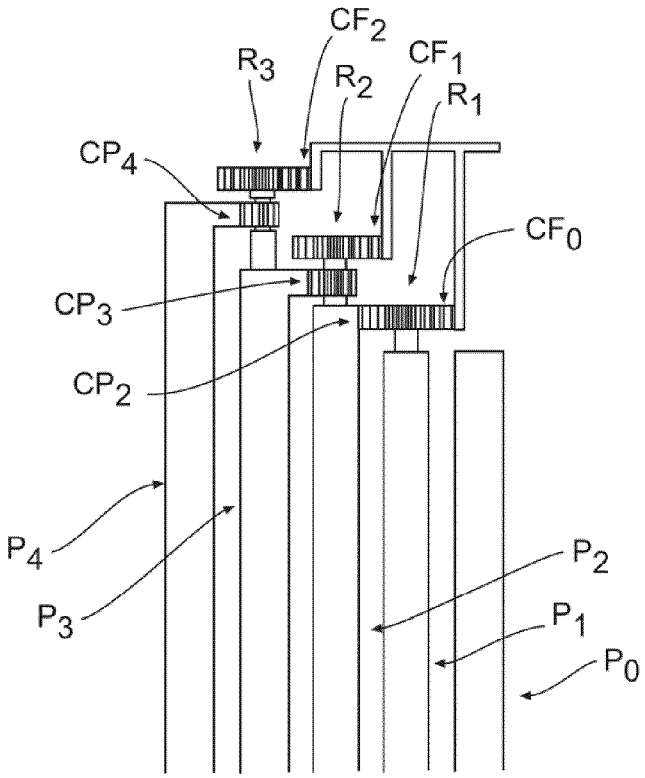
FIG. 2 is a side partial view of the multipanel sliding door of FIG. 1.

Referring to FIGS. 1 and 2 of the drawings, a first embodiment of the multipanel sliding door is comprised of a door header F extending parallel to a door runner not shown, which may be of any suitable kind known in the art, and a set of adjacent panels $P=\{P_0, P_1, P_2, P_3, P_4\}$, whereof a panel $P_0$ is stationary and the remaining panels $P_1$-$P_4$ are supported for travel in planes substantially parallel thereto. Panels $P_0$-$P_4$ have preferably equal width L.

For the movement of the panels, an arrangement is provided which is comprised of a first set of racks $CF=\{CF_0, CF_1, CF_2\}$ which are fixedly supported by door header F, a second set of racks $CP=\{CP_2, CP_3, CP_4\}$ which are attached to or formed unitarily with panels $P_2$, $P_3$, $P_4$, respectively, and a set of wheelworks $R=\{R_1, R_2, R_3\}$ which are rotatably mounted on panels $P_1$, $P_2$, $P_3$, respectively, and are designed to mesh together with first CF and second CP set of racks.

The length of racks $CF_0$, $CF_1$, $CF_2$ is equal to L, 2L, 3L, respectively, whereas the length of racks $CP_2$, $CP_3$, $CP_4$ is equal to L.

Sets of wheelworks R includes wheelwork $R_1$ formed of a single toothed wheel which is meshed together with rack $CF_0$ of set CF and with rack $CP_2$ of set CP, and wheelworks $R_2$, $R_3$ each formed of two coaxial and co-rotating toothed wheels, whereof a first larger diameter toothed wheel is meshed together with rack $CF_1$, $CF_2$, respectively, of set CF and a second smaller diameter toothed wheel is meshed together with rack $CP_3$, $CP_4$, respectively, of set CP.

The selection of a suitable ratio of the diameters of the toothed wheels forming wheelworks of set R is made under the criterion of providing a kinematical link whereby the displacement of the k-th panel $P_k$ is in any time k times the displacement of panel $P_1$.

In fact, in a multipanel sliding door as described above, comprising a set of panels P having each a width L, the door shall reach its full extension when panel $P_1$ has traveled a distance L, panel $P_2$ a distance 2L, panel $P_3$ a distance 3L, with respect to fixed panel $P_0$.

This may be formulated explicitly and generally by the rule that the displacement $s_k$ of the k-th panel $P_k$ is proportional to k, where subscript $k \geq 1$.

For determining in a general way the ratio of the diameters of the toothed wheels forming the k-th wheelwork $R_k$ of set R, one may note that when panel $P_k$ covers a distance $s_k$, panel $P_{k+1}$ which is adjacent thereto overtakes the former by a distance which is equal to:

$$s_{k+1}-s_k=n_k d_k \tag{1}$$

where $n_k$ is the rotational speed of wheelwork $R_k$, and $d_k$ is the diameter of the smaller toothed wheel of wheelwork $R_k$.

The rotational speed of the k-th wheelwork $R_k$ of set R is given by the relationship:

$$n_k=s_k/(\pi D_k) \tag{2}$$

where $D_k$ is the diameter of the larger toothed wheel of wheelwork $R_k$.

Substituting eq. 2 for $n_k$ in eq. 1 gives:

$$s_{k+1}-s_k=\pi s_k d_k/D_k \tag{3}$$

Under the general rule that the displacement $s_k$ of the k-th panel $P_k$, where subscript $k \geq 1$, is proportional to k, eventually the following relationship is obtained:

$$D_k/d_k=k \tag{4}$$

Thus, by applying eq. 4 in the case of the multipanel sliding door shown in FIGS. 1 and 2, one obtains the following ratios:

| Wheelwork $R_k$ | Ratio of wheel diameters $D_k/d_k$ |
|---|---|
| $R_1$ | 1(*) |
| $R_2$ | 2 |
| $R_3$ | 3 |

(*)Clearly, this corresponds to having a single wheel of diameter $D_1$.

By using the above ratios in the design of wheelworks $R_k$ of set R, the displacement $s_k$ of the k-th panel $P_k$ is proportional to k, where subscript k≥1, and the extension of the multipanel sliding door may range from L to (number of panels+1)×L, L being the width of each panel as mentioned above.

Figure 3:
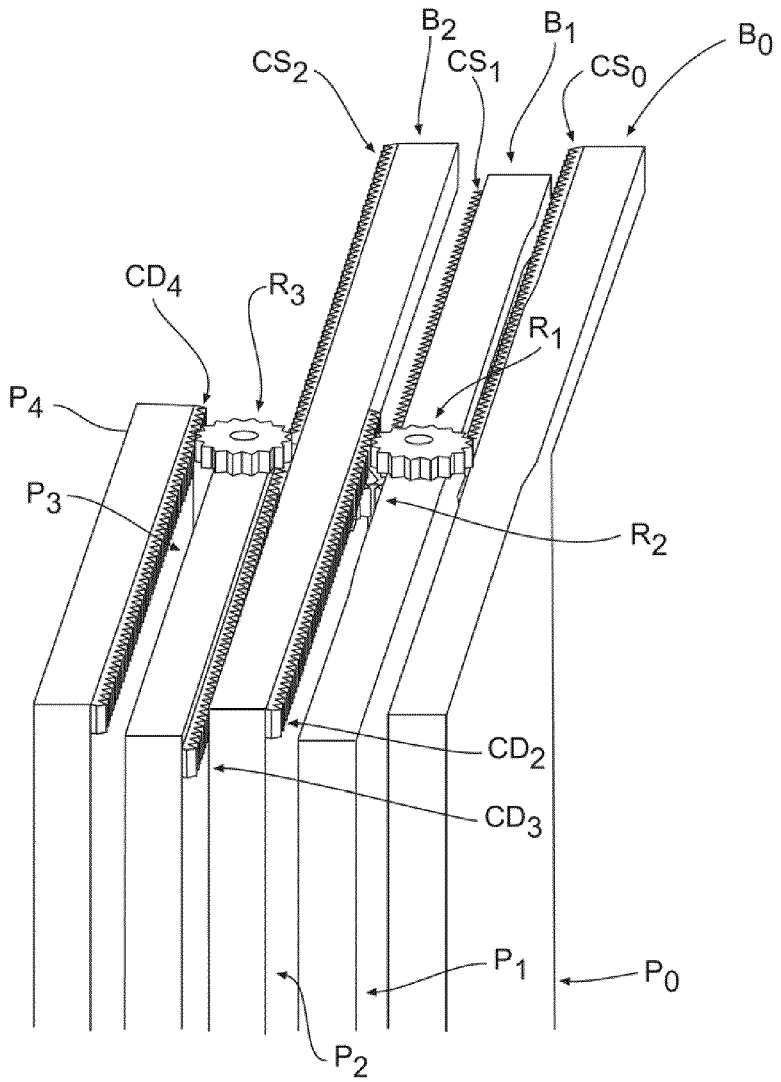
FIG. 3 is a perspective partial view of a second preferred embodiment of the multipanel sliding door according to the present invention.
Figure 4:
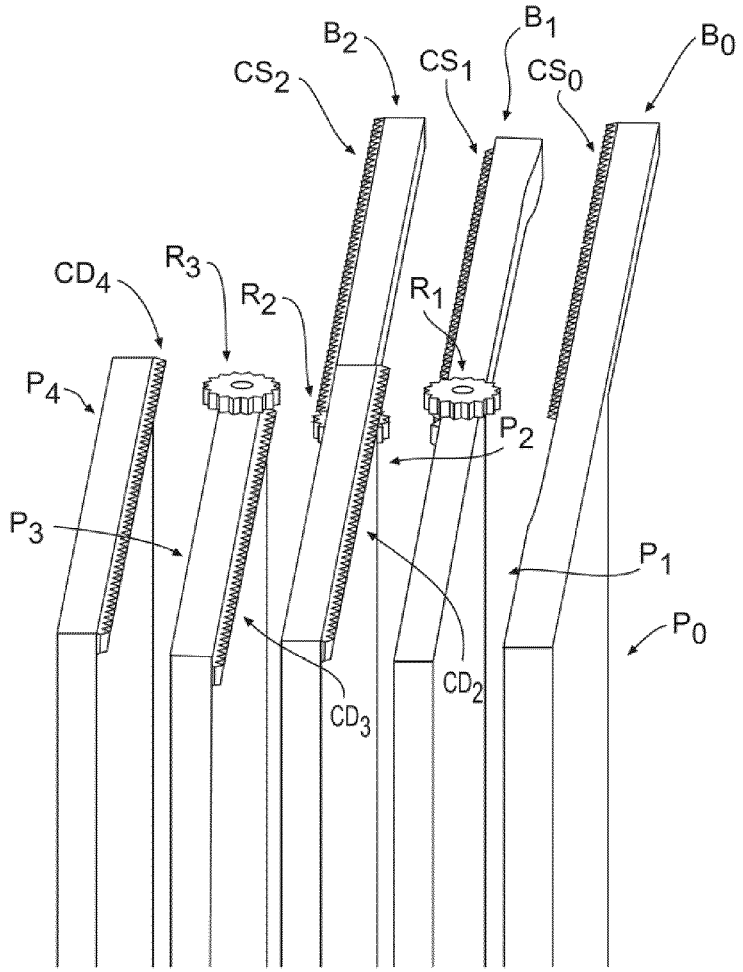
FIG. 4 is an exploded perspective partial view of the multipanel sliding door of FIG. 3.

Referring to FIGS. 3 and 4 of the drawings, a second embodiment of the multipanel sliding door is comprised of a set of adjacent panels $P=\{P_0, P_1, P_2, P_3, P_4\}$, whereof a panel $P_0$ is stationary and the remaining panels $P_1$-$P_4$ are supported for travel in planes substantially parallel thereto. Panels $P_0$-$P_4$ have preferably equal width L. Panels $P_0$, $P_1$, $P_2$ have an extension arm $B_0$, $B_1$, $B_2$, respectively, at their top which extends in the direction of travel of the panels.

For the movement of the panels an arrangement is provided which is comprised of a first set of racks $CS=\{CS_0, CS_1, CS_2\}$ which are attached to or formed unitarily with the extension arms $B_0$, $B_1$, $B_2$ of panels $P_0$, $P_1$, $P_2$, respectively, a second set of racks $CD=\{CD_2, CD_3, CD_4\}$ which are attached to or formed unitarily with panels $P_2$, $P_3$, $P_4$, respectively, and a set of wheelworks $R=\{R_1, R_2, R_3\}$ which are rotatably mounted on panels $P_1$, $P_2$, $P_3$, respectively, and are designed to mesh together with first CS and second CD set of racks.

Racks $CS_0$, $CS_1$, $CS_2$ are facing towards panels $P_1$, $P_2$, $P_3$, respectively, whereas racks $CD_2$, $CD_3$, $CD_4$ are facing towards panels $P_1$, $P_2$, $P_3$, respectively.

Also in this second embodiment, it is desirable that a kinematical link be provided whereby the displacement of the k-th panel $P_k$ is in any time k times the displacement of panel $P_1$.

In the second embodiment, one may observe that when panel $P_k$ travels a distance $s_k$, panel $P_{k+1}$ adjacent thereto overtakes the former by a distance which is equal to:

$$s_{k+1}-s_k=\pi n_k d_k \tag{5}$$

where $n_k$ is the rotational speed of wheelwork $R_k$, and $D_k$ is the diameter of the toothed wheel of wheelwork $R_k$.

The rotational speed of the k-th wheelwork $R_k$ of set R is given by the relationship:

$$n_k=(s_k-s_{k-1})/(\pi D_k) \tag{6}$$

Substituting eq. 6 for $n_k$ in eq. 5 gives:

$$s_{k+1}-s_k=s_k-s_{k-1} \tag{7}$$

and thus:

$$s_{k+1}=2s_k-s_{k-1} \tag{8}$$

where subscript k≥1.

Considering that $s_0=0$ because panel $P_0$ is stationary, from eq. 8 one obtains:

| Panel $P_{k+1}$ | Displacement $s_{k+1}$ |
|---|---|
| $P_2$ | $s_2 = 2s_1$ |
| $P_3$ | $s_3 = 2s_2 - s_1 = 3s_1$ |
| $P_4$ | $s_4 = 2s_3 - s_2 = 4s_1$ |

Thus, also with the arrangement of the second embodiment the desired kinematical link is obtained, i.e. the displacement of the k-th panel $P_k$ is in any time k times the displacement of panel $P_1$.

Both first and second embodiments include an end panel $P_0$ which is stationary and the movement of the remaining panels $P_1$-$P_4$ occurs always in a certain given direction with respect to the stationary panel.

Figure 5:
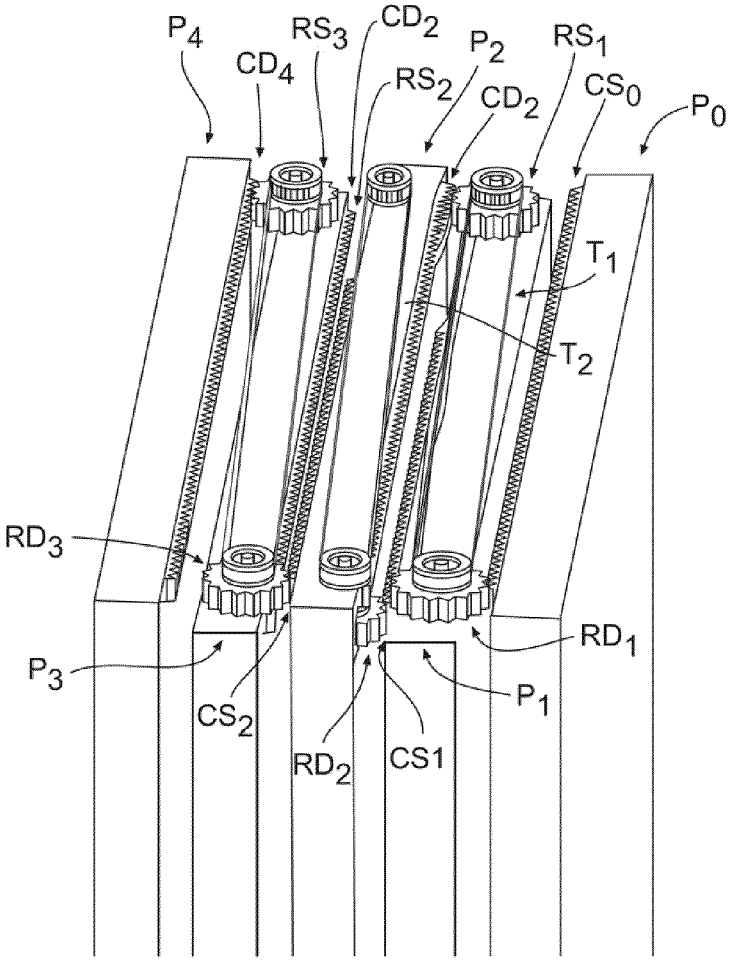
FIG. 5 is a perspective partial view of a third preferred embodiment of the multipanel sliding door according to the present invention.
Figure 6:
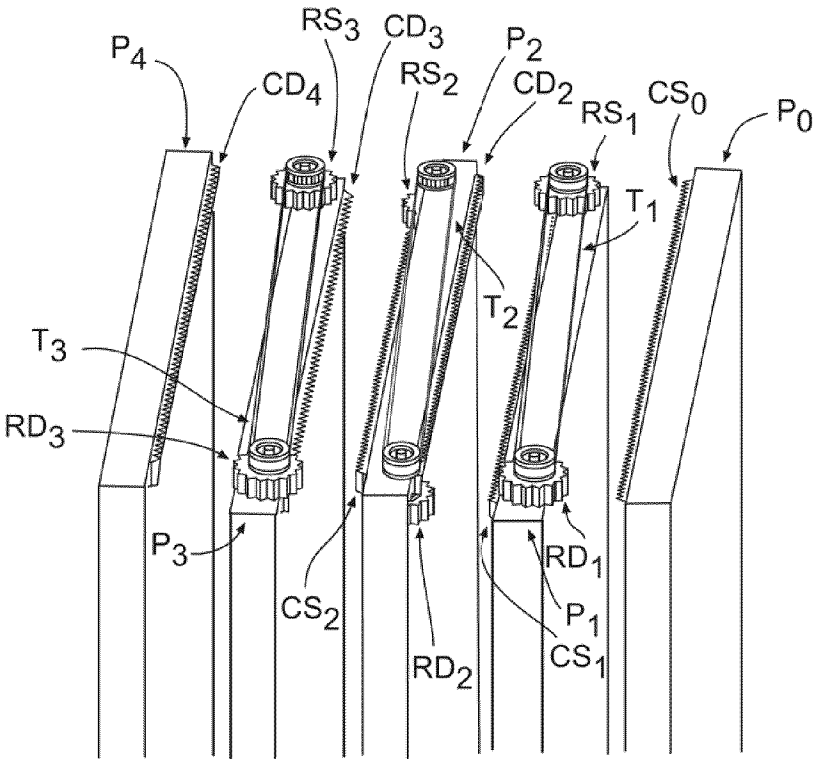
FIG. 6 is an exploded perspective partial view of the multipanel sliding door of FIG. 5.

This limitation can be overcome with the following third embodiment illustrated in FIGS. 5 and 6, wherein all the panels are supported for travel in substantially parallel planes and the multipanel sliding door can be extended in either direction desired, depending on which end panel is kept in a fixed position. Note that in the second and third embodiments the racks CD, CS and the wheelworks or gears R which engage them are mounted at alternating heights on the panels.

Referring to FIGS. 5 and 6 of the drawings, the third embodiment of the multipanel sliding door is comprised of a set of adjacent panels $P=\{P_0, P_1, P_2, P_3, P_4\}$, which are supported for travel in substantially parallel planes and have preferably equal width L.

For the movement of the panels an arrangement is provided which includes a first set of racks $CS=\{CS_0, CS_1, CS_2\}$ which are attached to or formed unitarily with panels $P_0$, $P_1$, $P_2$, a second set of racks $CD=\{CD_2, CD_3, CD_4\}$ which are attached to or formed unitarily with panels $P_2$, $P_3$, $P_4$, respectively, and a set of pairs of wheelworks $R=\{(RS_1, RD_1), (RS_2, RD_2), (RS_3, RD_3)\}$ which are rotatably mounted on panels $P_1$, $P_2$, $P_3$, respectively, and are designed to mesh together with first CS and second CD set of racks.

Racks $CS_0$, $CS_1$, $CS_2$ are facing towards panels $P_1$, $P_2$, $P_3$, respectively, whereas racks $CD_2$, $CD_3$, $CD_4$ are facing towards panels $P_1$, $P_2$, $P_3$, respectively.

Each pair of wheelworks $(RS_1, RD_1)$, $(RS_2, RD_2)$, $(RS_3, RD_3)$ includes a first wheelwork $RS_1$, $RS_2$, $RS_3$ designed to mesh together with rack $CD_2$, $CD_3$, $CD_4$, respectively, of second set of racks CD and a second wheelwork $RD_1$, $RD_2$, $RD_3$ designed to mesh with rack $CS_0$, $CS_1$, $CS_2$, respectively, of first set of racks CS.

The first and second wheelwork of each pair of wheelworks $(RS_1, RD_1)$, $(RS_2, RD_2)$, $(RS_3, RD_3)$ are interlinked with one another by a transmission $T_1$, $T_2$, $T_3$, respectively, in order to rotate at the same rotational speed. In the embodiment shown, transmission $T_1$, $T_2$, $T_3$ is formed of an endless belt.

In order to understand the operation of the third embodiment, one may consider for instance panel $P_0$ as a stationary panel and the remaining panels $P_1$-$P_4$ supported for travel in planes substantially parallel thereto.

Also in this third embodiment it is desirable that a kinematical link be provided whereby the displacement of the k-th panel $P_k$ is in any time k times the displacement of panel $P_1$.

In the third embodiment, one may observe that when panel $P_k$ travels a distance $s_k$, panel $P_{k+1}$ adjacent thereto overtakes the former by a distance which is equal to:

$$s_{k+1}-s_k=\pi n_k D_k \tag{9}$$

where $n_k$ is the rotational speed of wheelwork $R_k$, and $D_k$ is the diameter of the toothed wheel of wheelwork $R_k$.

The rotational speed of the k-th wheelwork $R_k$ of set R is given by the relationship:

$$n_k=(s_k-s_{k-1})/(\pi D_k) \tag{10}$$

Substituting eq. 10 for $n_k$ in eq. 9 gives:

$$s_{k+1}-s_k=s_k-s_{k-1} \tag{11}$$

and thus:

$$s_{k+1}=2s_k-s_{k-1} \tag{12}$$

where subscript k≥1.

Considering that $s_0=0$ because panel $P_0$ is assumed to be the stationary end panel, from eq. 12 one obtains:

| Panel $P_{k+1}$ | Displacement $s_{k+1}$ |
|---|---|
| $P_2$ | $s_2 = 2s_1$ |
| $P_3$ | $s_3 = 2s_2 - s_1 = 3s_1$ |
| $P_4$ | $s_4 = 2s_3 - s_2 = 4s_1$ |

Thus, also with the arrangement of the third embodiment the desired kinematical link is obtained, i.e. the displacement of the k-th panel $P_k$ is in any time k times the displacement of panel $P_1$ assuming that $P_0$ designates the end panel which is kept in a fixed position.

The invention claimed is:

1. A multipanel sliding door comprising:

a set of at least four adjacent panels including a first panel, a last panel and plural intermediate panels, wherein the first panel is stationary and the intermediate and last panels are supported in a direction of travel substantially parallel thereto, the panels having an equal width, and each of the intermediate panels having a gear meshing respectively with a respective first rack on a previous adjacent panel and with a respective second rack on a subsequent adjacent panel, wherein each of said first racks is mounted on an extension arm extending from a top of a respective panel beyond the width of the panel in the direction of travel, each gear is mounted on each panel at a different and alternated height with respect to the height where the gear of an adjacent panel is mounted, so that the gear of each panel does not interfere with the gear of an adjacent panel and the gears and the racks are dimensioned so that a kinematic link is provided whereby the displacement of each panel with respect to the first panel at any time is a multiple of the displacement of the second panel with respect to the first panel.

* * * * *